US006392510B2

(12) United States Patent
Gregorwich

(10) Patent No.: US 6,392,510 B2
(45) **Date of Patent: *May 21, 2002**

(54) RADIO FREQUENCY THERMAL ISOLATOR

(75) Inventor: Walter S. Gregorwich, Los Altos, CA (US)

(73) Assignee: Lockheed Martin Corporation, Bethesda, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/272,324

(22) Filed: Mar. 19, 1999

(51) Int. Cl.[7] ..... H01P 1/04

(52) U.S. Cl. ..... 333/245; 333/254; 333/260; 333/99 R; 333/99 S

(58) Field of Search ..... 333/245, 254, 333/260, 99 R, 99 S

(56) References Cited

U.S. PATENT DOCUMENTS

| | | | | | |
|---|---|---|---|---|---|
| 3,970,969 | A | * | 7/1976 | Sirel et al. | 333/260 X |
| 5,120,705 | A | * | 6/1992 | Davidson et al. | 333/260 X |

FOREIGN PATENT DOCUMENTS

| | | | | |
|---|---|---|---|---|
| DE | 3133362 | * | 3/1983 | 333/254 |
| JP | 46501 | * | 3/1982 | 333/254 |
| JP | 114501 | * | 7/1983 | 333/245 |
| JP | 134501 | * | 8/1983 | 333/245 |
| JP | 175801 | * | 7/1991 | 333/245 |

OTHER PUBLICATIONS

Gregorwich, "High–$T_c$ Superconductivity in Satellite Systems: A Technology Assessment", *IEEE*, vol. 5 of 5, Mar./1998.

Davidovitz, "A Low–Loss Thermal Isolator for Waveguides and Coaxial Transmission Lines", *IEEE*, Vol. 6, No. 1, Jan./1996.

* cited by examiner

*Primary Examiner*—Benny Lee
(74) *Attorney, Agent, or Firm*—Swidler Berlin Shereff Friedman, LLP

(57) ABSTRACT

A radio frequency (RF) thermal isolator and method of manufacture for same. According to one embodiment, the RF thermal isolator includes a first transmission line; a second transmission line of nominally the same dimensions as the first transmission line and axially aligned with the first transmission line, wherein the ends of the transmission lines are separated by a gap having a width that is a very small fraction of the center operating wavelength of the transmission lines; and an electrically conductive sleeve electrically attached to the end of the first transmission line and surrounding the end of the second transmission line and separated from the second transmission line by a gap having a width that is a very small fraction of the center operating wavelength of the transmission lines; wherein the sleeve extends along the second transmission line from the end of the first transmission line for a distance of nominally ¼ of the center operating wavelength of the transmission lines.

31 Claims, 3 Drawing Sheets

RADIO FREQUENCY THERMAL ISOLATOR

BACKGROUND OF THE INVENTION

1. Field of the Invention

The present invention relates generally to thermal isolation, and more particularly to thermal isolation in radio frequency (RF) transmission lines coupled to cooled systems.

2. Related Art

Any radio frequency (RF) conductor, such as a cable or waveguide, that includes a metallic component conducts heat. When such an RF conductor is used for connection to a cooled system, heat is transmitted to the cooled system through the RF conductor. The result is a loss of cooling in the cooled system, an increase in the power needed to maintain the desired temperature in the cooled system, or both.

One example of a cooled system is a transceiver placed in a dewar cryogenically cooled by liquid nitrogen to approximately 77 degrees Kelvin. By employing high temperature superconductivity (HTS) technology, such systems can achieve reductions in weight, size and RF loss. One potential application for such an HTS transceiver is in a cellular telephone base station, where there is a demand for a low-noise high-performance front end. Another potential application for an HTS transceiver is on board a communications satellite, where there are similar requirements.

One approach to achieving thermal isolation is to simply cut a gap in the transmission line. While this approach provides excellent thermal isolation, it unfortunately also produces large ohmic signal loss.

Another approach is to use very thin transmission lines to reduce heat flow through the transmission lines. While this approach provides moderate thermal isolation, it also produces moderate signal loss. Further, such transmission lines are unreliable due to their fragility.

SUMMARY OF THE INVENTION

The present invention is a radio frequency (RF) thermal isolator and method of manufacture for same. According to one embodiment, the RF thermal isolator includes a first transmission line; a second transmission line of nominally the same dimensions as the first transmission line and axially aligned with the first transmission line, wherein the ends of the transmission lines are separated by a gap having a width that is a very small fraction of the center operating wavelength at the operating frequency of the transmission lines; and an electrically conductive sleeve electrically attached to the end of the first transmission line and surrounding the end of the second transmission line and separated from the second transmission line by a gap having a width that is a very small fraction of the center operating wavelengths at the operating frequency of the transmission lines; wherein the sleeve extends along the second transmission line from the end of the first transmission line for a distance of nominally ¼ of the center operating wavelength at the operating frequency of the transmission lines.

In one aspect the gaps have a width that is nominally 1/100 of the center operating wavelength at the operating frequency of the transmission lines.

In one embodiment, each of the transmission lines is a waveguide. In another embodiment, each of the transmission lines is a coaxial cable having an inner conductor and an outer conductor. A center conductor extends axially from the inner conductor of the first transmission line into a cavity in the center conductor of the second transmission line, wherein the center conductor extends beyond the end of the first transmission line for a length that is nominally ¼ of the center operating wavelength at the operating of transmission lines. The cavity extends into the center conductor of the second transmission line for a distance of nominally ½ of the center operating wavelength of the transmission lines.

In one aspect the RF thermal isolator includes a mechanical coupler attached between the transmission lines.

In one aspect the transmission lines and sleeve are fabricated from a conductive metal.

In one aspect the transmission lines and sleeve are fabricated from a composite material coated with a metallic layer.

In one aspect the inner conductors of the coaxial cables are hollow, and the cavities within the RF thermal isolator are vented to each other and to the exterior of the RF thermal isolator.

The method of manufacture includes electrically attaching an electrically conductive sleeve upon the outer surface of a first transmission line, wherein the sleeve extends beyond an end of the first transmission line for a distance of nominally ¼ of the center operating wavelength at the operating frequency of the first transmission line, and disposing an end of a second transmission line of nominally the same dimensions as the first transmission line within the sleeve such that the second transmission line is axially aligned with the first transmission line and the ends of the transmission lines are separated by a gap having a width that is a very small fraction of the center operating wavelength at the operating frequency of the transmission lines; wherein the sleeve surrounds the end of the second transmission line and is separated from the second transmission line by a gap having a width that is a very small fraction of the center operating wavelength at the operating frequency of the transmission lines.

According to one embodiment, each of the transmission lines is a waveguide.

According to another embodiment, each of the transmission lines is a coaxial cable having an inner conductor and an outer conductor, and the method includes forming a cavity in the center conductor of the second transmission line, the cavity having a length of nominally ½ of the center operating wavelength at the operating frequency of the transmission lines; and mounting a center conductor upon the inner conductor of the first transmission line such that the center conductor extends axially from the inner conductor of the first transmission line into the cavity in the center conductor of the second transmission line, wherein the center conductor extends beyond the end of the first transmission line for a length that is nominally ¼ of the center operating wavelength at the operating frequency of the transmission lines.

In one aspect the method includes mounting a mechanical coupler between the transmission lines.

In one aspect the method includes mounting a mechanical coupler between the sleeve and the second transmission line.

In one aspect the method includes mounting a retainer upon the second transmission line; and mounting a mechanical coupler between the sleeve and the retainer.

In one aspect the transmission lines and sleeve are fabricated from a conductive metal.

In one aspect the transmission lines and sleeve are fabricated from a composite material coated with a metallic layer.

In one aspect the inner conductor of the coaxial cables is hollow, and the cavities within the coaxial cables and the sleeve are vented to each other and to the exterior of the RF thermal isolator.

In one aspect the gaps have a width that is nominally 1/100 of the center operating wavelength at the operating frequency of the transmission lines.

According to one embodiment, the present invention includes the product made by the process of the methods described above.

One advantage of the present invention is that it provides excellent thermal isolation with minimal signal loss.

Further features and advantages of the present invention as well as the structure and operation of various embodiments of the present invention are described in detail below with reference to the accompanying drawings.

BRIEF DESCRIPTION OF THE DRAWINGS

The present invention will be described with reference to the accompanying drawings.

DETAILED DESCRIPTION OF THE PREFERRED EMBODIMENTS

The present invention is described in terms of the above example. This is for convenience only and is not intended to limit the application of the present invention. In fact, after reading the following description, it will be apparent to one skilled in the relevant art how to implement the present invention in alternative embodiments.

The present invention is an RF thermal isolator that provides a very high thermal resistance with no appreciable RF signal loss. The isolator can be used in any transmission line, including waveguides and coaxial cables. The isolator is effective at all RF frequencies, ranging from high frequency up to and including millimeter wave frequencies.

The isolator has a very wide bandwidth, sufficient for cellular and satellite applications. For an ultrawide bandwidth application, a plurality of isolator outer chokes are arranged in series, each configured for different frequencies within the bandwidth. By placing several RF thermal isolators in series, one can increase the thermal isolation.

Figure 1:
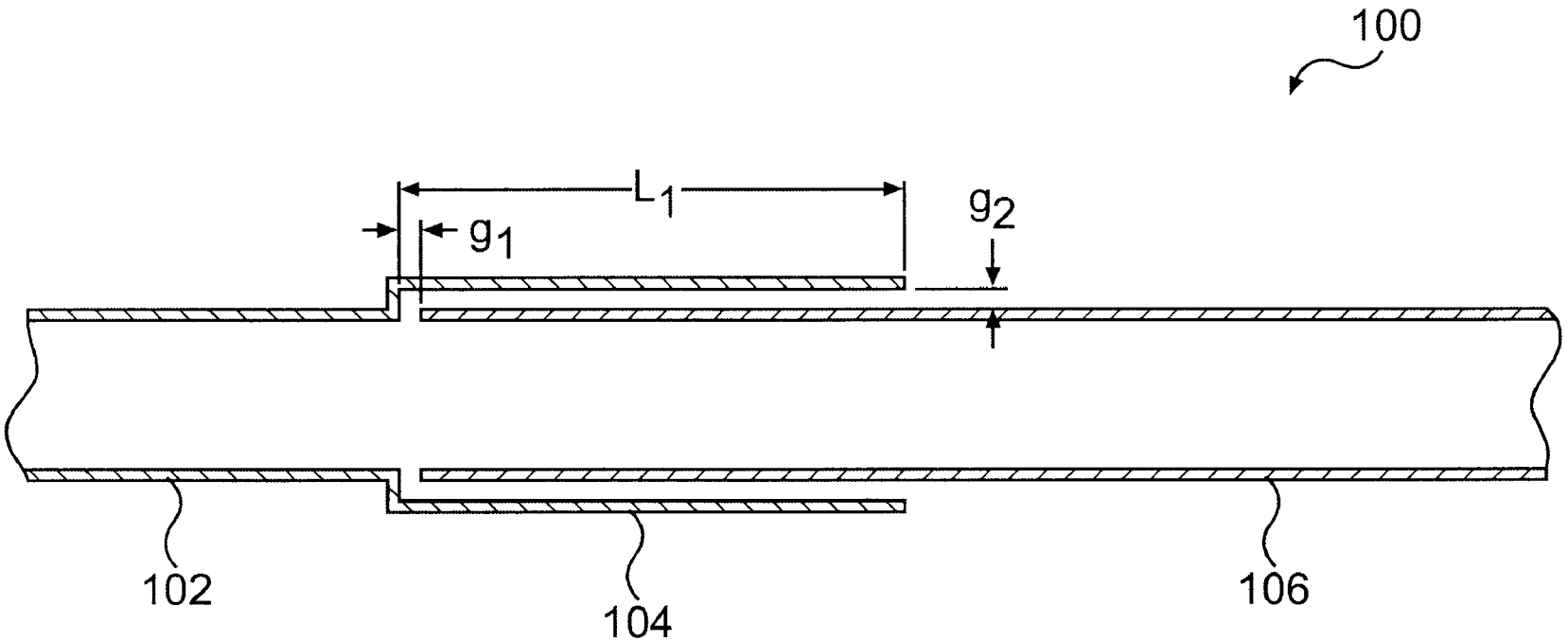
FIG. 1 is a cross-sectional view of a waveguide RF thermal isolator according to a preferred embodiment of the present invention.

FIG. 1 is a cross-sectional view of a waveguide RF thermal isolator 100 according to a preferred embodiment of the present invention. RF thermal isolator 100 includes standard waveguides 102 and 106 and an RF choke 104. In a preferred embodiment, RF choke 104 is a sleeve fabricated from the same materials as waveguides 102 and 106. These materials can include conductive metals, such as copper and gold-plated stainless steel, composite materials coated with a metallic layer, and other materials. In one embodiment, RF choke 104 is electrically attached to an end of waveguide 102. In another embodiment, RF choke 104 is formed by flaring an end of waveguide 102.

In either embodiment, the length of RF choke 104 is $L_1$. In a preferred embodiment, $L_1$ is nominally ¼ of the center operating wavelength at the operating frequency of waveguides 102 and 106.

An end of waveguide 106 extends within RF choke 104. The ends of waveguides 102 and 106 are separated by a gap $g_1$. In a preferred embodiment, $g_1$ is nominally 1/100 of the center operating wavelength at the operating frequency of waveguides 102 and 106.

RF choke 104 is separated from the outer surface of waveguide 106 by a gap $g_2$. In a preferred embodiment, $g_2$ is nominally 1/100 of the center operating wavelength at the operating frequency of waveguides 102 and 106.

In other embodiments, $g_1$ and $g_2$ are of different dimensions, selected according to the desired impedance by methods well-known in the art. In general $g_1$ and $g_2$ are a very small fraction of the center operating wavelength at the operating frequency of waveguides 102 and 106.

RF thermal isolator 100 presents an RF short circuit path to the signal traversing waveguides 102 and 106, thereby minimizing RF loss. However, RF thermal isolator 100 presents a thermal open circuit, thereby minimizing heat transmission between waveguides 102 and 106.

In a preferred embodiment, waveguides 102 and 106 and RF choke 104 are held in place by a mechanical couple (not shown). In a preferred embodiment, the mechanical coupler is a tube made from a nonconductive material such as G10 fiberglass, a laminate made of fiberglass laid in epoxy resin. In another embodiment, the mechanical coupler is implemented as one or more fasteners, such as set screws, extending radially inward from RF choke 104 to seat against the outer surface of waveguide 106.

In one embodiment, RF thermal isolator 100 is employed within a spacecraft system designed to operate within a vacuum. Therefore, the cavity within waveguides 102 and 106 is vented to the exterior of the waveguides.

Figure 2:
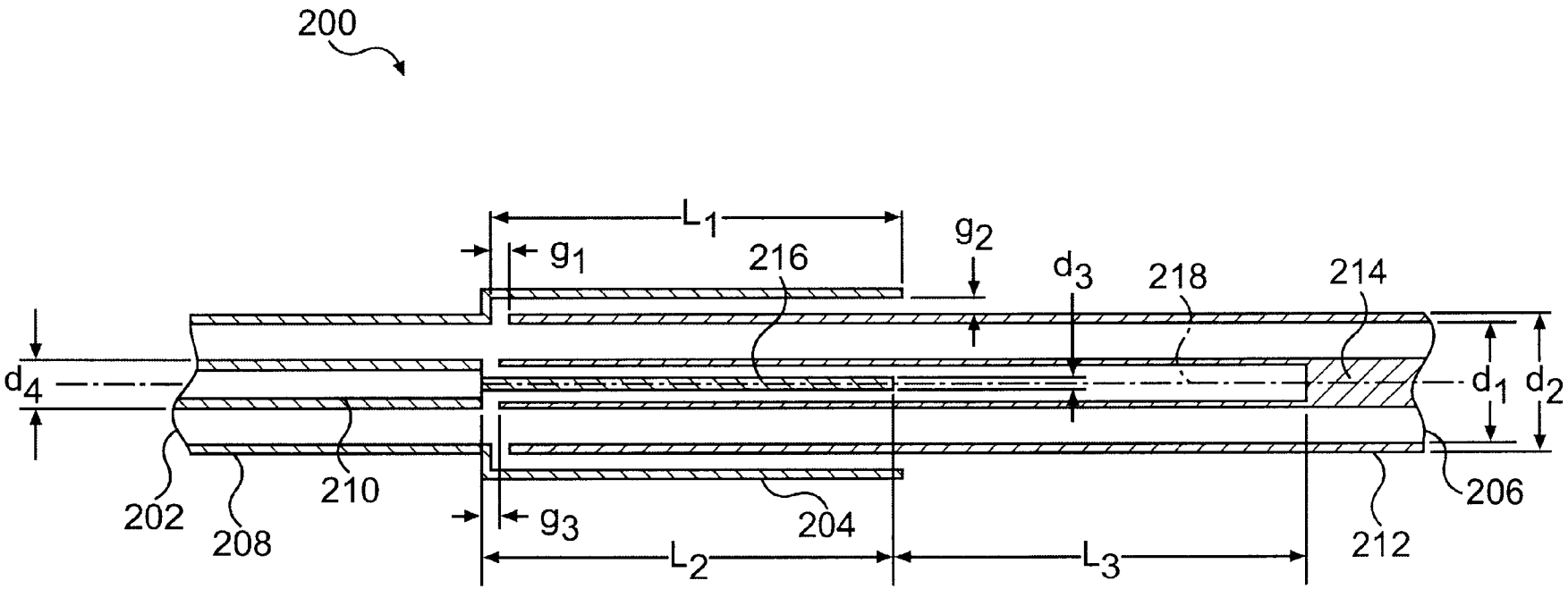
FIG. 2 is a cross-sectional view of a coaxial RF thermal isolator according to a preferred embodiment of the present invention.

FIG. 2 is a cross-sectional view of a coaxial RF thermal isolator 200 according to a preferred embodiment of the present invention. RF thermal isolator 200 includes standard coaxial cables 202 and 206, an inner conductor extension a sleeve 216, and 204.

Coaxial cable 202 includes an outer conductor 208 and an inner conductor 210. Coaxial cable 206 includes an outer conductor 212 and an inner conductor 214.

In one embodiment, sleeve 204 is electrically attached to an end of coaxial cable 202 at its outer conductor 208. In another embodiment, sleeve 204 is formed by flaring an end of outer conductor 208. In a preferred embodiment, RF choke 204 is fabricated from the same materials as coaxial cables 202 and 206. These materials include conductive metals, such as copper and gold-plated stainless steel, composite materials coated with a metallic layer, and other materials.

The length of sleeve 204 is $L_1$. In a preferred embodiment, $L_1$ is nominally ¼ of the center operating wavelength at the operating frequency of coaxial cables 202 and 206.

An end of coaxial cable 206 extends within sleeve forming an outer RF choke 204. Outer conductor 208 of coaxial cable 202 is separated from outer conductor 212 of coaxial cable 206 by a gap $g_1$. In a preferred embodiment, $g_1$ is nominally 1/100 of the center operating wavelength at the operating frequency of waveguides 202 and 206.

Sleeve 204 is separated from outer conductor 212 of coaxial cable 206 by a gap $g_2$. In a preferred embodiment, $g_2$ is nominally 1/100 of the center operating wavelength at the operating frequency of coaxial cables 202 and 206.

Inner conductor 210 of coaxial cable 202 is separated from inner conductor 214 of coaxial cable 206 by a gap $g_3$.

In a preferred embodiment, $g_3$ is nominally 1/100 of the center operating wavelength at the operating frequency of coaxial cables 202 and 206.

In other embodiments, $g_1$, $g_2$ and $g_3$ are of different dimensions, selected according to the desired impedance by methods well-known in the art. In general $g_1$, $g_2$ and $g_3$ are a very small fraction of the center operating wavelength at the operating frequency of coaxial cables 202 and 206.

Inner conductor 214 of coaxial cable 206 includes a cavity 218. Inner conductor extension 216 is electrically attached to inner conductor 210 of coaxial cable 202. Inner conductor extension 216 extends within cavity 218 for a distance L2 forming an inner RF choke. Cavity 218 extends beyond inner conductor extension 216 for a distance $L_3$. Therefore, cavity 218 has a total depth of $L_2+L_3-g_3$. In a preferred embodiment, $L_1$, $L_2$ and $L_3$ are each nominally ¼ of the center operating wavelength at the operating frequency of coaxial cables 202 and 206.

Outer conductors 212 and 208 each have an inner diameter $d_1$ and an outer diameter $d_2$. Inner conductor extension has a diameter $d_3$. Inner conductors 210 and 214 have an outer diameter $d_4$.

In one embodiment, the center operating wavelength at the operating frequency of coaxial cables 202 and 206 is 2.96 inches. Therefore, $L_1=L_2=L_3=0.74$ inches. Also, $g_1=g_2=g_3=0.030$ inches, $d_1=0.22$ inches, $d_2=0.25$ inches, $d_3=0.020$ inches, and $d_4=0.087$ inches.

In a preferred embodiment, coaxial cables 202 and 206 and outer RF choke 204 are held in place by a mechanical couple (not shown). In a preferred embodiment, the mechanical coupler is a tube made from a nonconductive material such as G10 fiberglass, a laminate made of fiberglass laid in epoxy resin. In another embodiment, the mechanical coupler is implemented as one or more fasteners, such as set screws, extending radially inward from outer RF choke 204 to seat against the outer surface of outer conductor 212.

In a preferred embodiment, inner conductors 210 and 214 are hollow to provide venting in a vacuum system, such as a dewar. Inner conductor extension 216 is coupled to inner conductor 210 by a vented plug (not shown) formed within inner conductor 210. Cavity 218 is formed by placing a vented plug within inner conductor 214 at a distance $L_2+L_3-g_3$ from its opening.

RF thermal isolator 200 presents an RF short circuit path to the signal traversing coaxial cables 202 and 206, thereby minimizing RF loss however, RF thermal isolator 200 presents a thermal open circuit, thereby minimizing heat transmission between coaxial cables 202 and 206.

Figure 3:
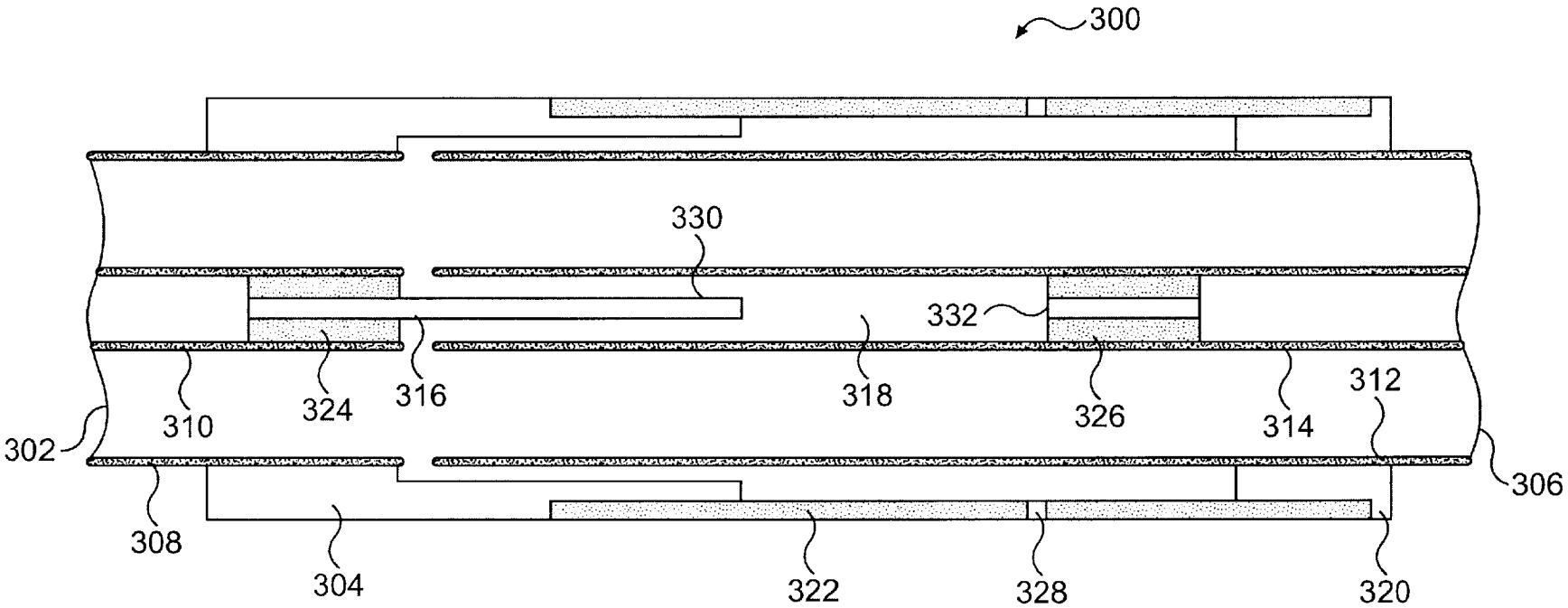
FIG. 3 is a cross-sectional view of a coaxial RF thermal isolator according to a preferred embodiment of the present invention.

FIG. 3 is a cross-sectional view of a coaxial RF thermal isolator 300 according to a preferred embodiment of the present invention. RF thermal isolator 300 includes standard coaxial cables 302 and 306. Coaxial cable 302 includes an outer conductor 308 and an inner conductor 310. Coaxial cable 306 includes an outer conductor 312 and an inner conductor 314.

An outer RF choke 304 is electrically attached to outer conductor 308. A retainer 320 is attached to outer conductor 312. A mechanical coupler 322 is attached to RF choke 304 and retainer 320.

In one embodiment, RF thermal isolator 300 is employed within a vacuum. Therefore, the cavities within coaxial cables 302 and 306 are vented with respects to each other and to the exterior of the coaxial cables. Thus an axial passage 330 is formed within inner conductor 316 and its mounting plug 324 so that the interior of inner conductor 310 and cavity 318 are in fluid communication. Similarly, an axial passage 332 is formed within plug 326 at the end of cavity 318 so that the interior of inner conductor 314 and cavity 318 are in fluid communication. Cavity 318, the cavity between inner conductor 310 and outer conductor 308, and the cavity between inner conductor 314 and outer conductor 312 are in fluid communication. This cavity is in fluid communication with the cavity between outer RF choke 304 and outer conductor 312. The space formed by these cavities is vented to the exterior by a small vent hole 328 in mechanical coupler 322.

CONCLUSION

While various embodiments of the present invention have been described above, it should be understood that they have been presented by way of example, and not limitation. It will be apparent to persons skilled in the relevant art that various changes in form and detail can be placed therein without departing from the spirit and scope of the invention. Thus the present invention should not be limited by any of the above-described example embodiments, but should be defined only in accordance with the following claims and their equivalents.

What is claimed is:

1. A radio frequency (RF) thermal isolator, comprising:

a first transmission line having an operating frequency;

a second transmission line having the operating frequency and being axially aligned with the first transmission line, wherein the first and second transmission lines have respective ends, the respective ends separated from each other by a first hollow gap; and an electrically conductive sleeve electrically coupled to the end of the first transmission line and positioned about the end of the second transmission line, the electrically conductive sleeve being separated from the second transmission line by a second hollow gap, the second hollow gap being axially aligned with the second transmission line and extending continuously from the surface of the second transmission line to bottom of the sleeve.

2. The RF thermal isolator of claim 1, wherein each of the transmission lines is a respective waveguide.

3. The RF thermal isolator of claim 1, wherein each of the transmission lines is a respective coaxial cable having a respective inner conductor and a respective outer conductor, further comprising:

an inner conductor extension extending axially from the inner conductor of the first transmission line into a cavity in the inner conductor of the second transmission line, wherein the inner conductor extension of the first transmission line extends beyond the end of the first transmission line for a length that is substantially ¼ of the center operating wavelength at the operating frequency of the first and second transmission lines;

wherein the cavity extends into the inner conductor of second transmission line for a distance substantially ½ of the center operating wavelength at the operating frequency of the first and second transmission lines.

4. The RF thermal isolator of claim 3, wherein the respective inner conductors of the transmission lines are hollow, and vented with respect to each other and to the exterior of the RF thermal isolator.

5. The RF thermal isolator of claim 1, wherein the transmission lines and sleeve are comprised of a conductive metal.

6. The RF thermal isolator of claim 1, wherein the transmission lines and sleeve are comprised of a composite material coated with a metallic layer.

7. The RF thermal isolator of claim 1, further comprising:

a mechanical coupler attached between the transmission lines.

8. The RF thermal isolator of claim 1, wherein the first hollow gap and the second hollow gap each have a width that is nominally 1/100 of the center of the operating wavelength at the operating frequency.

9. The RF thermal isolator according to claim 1, wherein the first hollow gap and the second hollow gap thermally isolate heat transmission between the first and second transmission lines.

10. The RF thermal isolator of claim 1, wherein the first hollow gap has a width that is a very small fraction of a center operating wavelength at the operating frequency.

11. The RF thermal isolator of claim 1, wherein the second hollow gap has a width that is a very small fraction of a center operating wavelength at the operating frequency.

12. The RF thermal isolator of claim 1, wherein the sleeve extends along the second transmission line for a distance that is about ¼ of the center operating wavelength at the operating frequency.

13. The RF thermal isolator of claim 1, wherein the first transmission line has a first temperature and the second transmission line has a second temperature different than the first temperature.

14. A method comprising:

electrically coupling an electricity conductive sleeve upon the outer surface of a first transmission line, the first transmission line having an operating frequency; and disposing an end of a second transmission line having the operating frequency within the sleeve such that the second transmission line is axially aligned with the first transmission line and the ends of the first and second transmission lines are separated by a first hollow gap;

wherein the sleeve is positioned about the end of the second transmission line, the sleeve being separated from the second transmission line by a second hollow gap, the second hollow gap being axially aligned with the second transmission line and extending continuously from the surface of the second transmission line to bottom of the sleeve.

15. The method of claim 14, further comprising: fabricating the transmission lines and sleeve from a conductive metal.

16. The method of claim 14, further comprising: fabricating the transmission lines and sleeve from a composite material coated with a metallic layer.

17. The method of claim 14, wherein the first transmission line has a first temperature and the second transmission line has a second temperature different than the first temperature.

18. The method of claim 14, wherein the first hollow gap and the second hollow gap each have a width that is nominally 1/100 of the center of the operating wavelength at the operating frequency.

19. A product made by the process of claim 14.

20. The method of claim 14, wherein each of the transmission lines is a respective coaxial cable having a respective inner conductor and a respective outer conductor, further comprising:

forming a cavity in the inner conductor of the second transmission line, the cavity having a length of substantially ½ of the center operating wavelength at the operating frequency of the first and second transmission lines; and mounting an inner conductor extension upon the inner conductor of the first transmission line such that the inner conductor extension extends axially from the inner conductor of the first transmission line into the cavity in the inner conductor of the second transmission line, wherein the center conductor of the first transmission line extends beyond the end of the first transmission line for a length that is substantially ¼ of the center operating wavelength at the operating frequency of the first and second transmission lines.

21. A product made by the process of claim 20.

22. The method of claim 20, wherein the respective inner conductors of the transmission lines are hollow, further comprising: venting the respective inner conductors of the transmission lines with respect to each other and to the exterior of the RF thermal isolator.

23. The method of claim 14, wherein the first hollow gap and the second hollow gap thermally isolate heat transmission between the first and the second transmission lines.

24. The method of claim 14, wherein each of the transmission lines is a respective waveguide.

25. A product made by the process of claim 24.

26. The method of claim 14, wherein the second hollow gap has a width that is a very small fraction of a center operating wavelength at the operating frequency.

27. The method of claim 14, wherein the first hollow gap has a width that is a very small fraction of a center operating wavelength at the operating frequency.

28. The method of claim 14, wherein the sleeve extends beyond an end of the first transmission line for a distance that is about ¼ of the center operating wavelength at the operating frequency.

29. The method of claim 14, further comprising:

mounting a mechanical coupler between the first and second transmission lines.

30. The method of claim 29, wherein the step of mounting a mechanical coupler between the transmission lines comprises:

mounting a mechanical coupler between the sleeve and the second transmission line.

31. The method of claim 30, wherein the step of mounting a mechanical coupler between the transmission lines comprises:

mounting a retainer upon the second transmission line; and mounting a mechanical coupler between the sleeve and the retainer.

* * * * *